United States Patent [19]

Cushing et al.

[11] 4,150,679

[45] Apr. 24, 1979

[54] DISHWASHER WITH IMPROVED BYPASS FILTER ARRANGEMENT

[75] Inventors: Donald S. Cushing; Thomas E. Jenkins, both of Louisville, Ky.

[73] Assignee: General Electric Company, Louisville, Ky.

[21] Appl. No.: 854,308

[22] Filed: Nov. 23, 1977

[51] Int. Cl.[2] ..... B08B 3/02

[52] U.S. Cl. ..... 134/104; 134/111; 134/182

[58] Field of Search ..... 134/104, 154, 182–183, 134/111

[56] References Cited

U.S. PATENT DOCUMENTS

| | | | |
|---|---|---|---|
| 1,864,064 | 6/1932 | Hall | 134/104 X |
| 1,884,180 | 10/1932 | Pauly | 134/182 X |
| 2,733,723 | 2/1956 | Whitcomb | 134/111 |
| 3,356,431 | 12/1967 | Martiniak | 134/182 X |
| 3,709,236 | 1/1973 | Field et al. | 134/183 X |
| 3,807,419 | 4/1974 | Cushing et al. | 134/104 |

*Primary Examiner*—Robert L. Bleutge

*Attorney, Agent, or Firm*—Bruce A. Yungman; Radford M. Reams

[57] ABSTRACT

An automatic dishwashing machine is provided with bypass soil-collecting and filter means disposed independent of the sump whereby food soil suspended in the recirculating washing liquid is filtered and collected in a receptacle during the washing/rinsing operation. It includes supplemental liquid collecting means disposed in a flow path separate and upstream of the soil-collecting means and operative to channel an additional quantity of recirculating washing liquid to the soil-collecting means. Drain means removes the washing liquid and the filtered food soil from the receptacle during the drain cycle.

6 Claims, 3 Drawing Figures

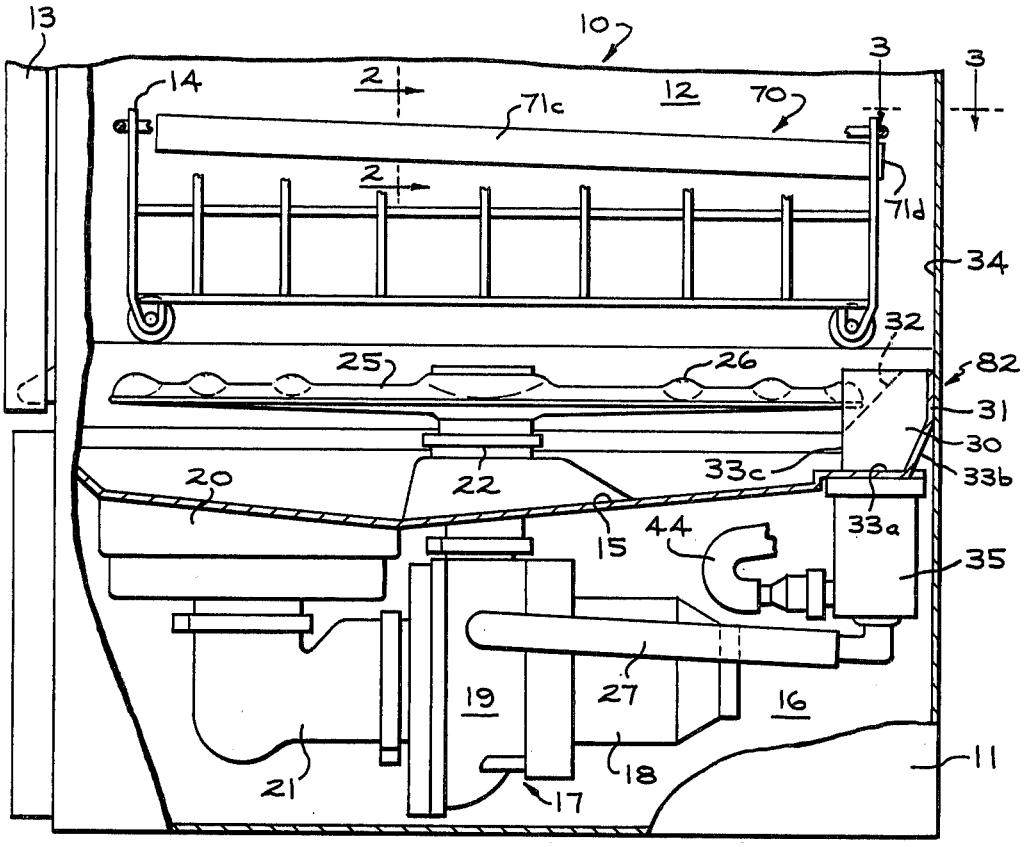
FIG. 1
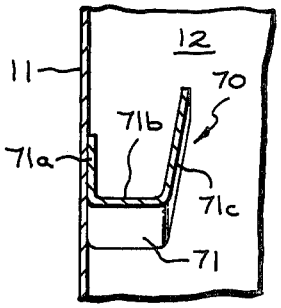
FIG. 2
FIG. 3
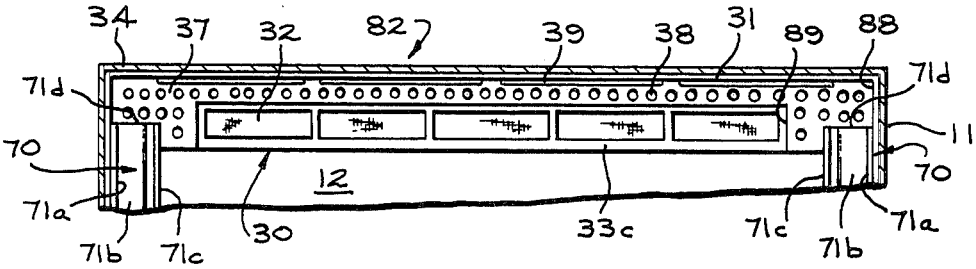

DISHWASHER WITH IMPROVED BYPASS FILTER ARRANGEMENT

BACKGROUND OF THE INVENTION

The domestic automatic dishwasher is generally of the type having a washing chamber with open-framework racks therein for holding dishes to be washed and means for recirculating washing liquid accumulated in the lower end of the washing chamber upwardly over the dishes to loosen and carry away food soil therefrom. An inherent problem in such a machine is that food soil particles are suspended in the recirculating flow of washing liquid and that redeposition of these particles on the clean dishes can occur during the cleaning process. During the recirculation of the washing liquid large food particles flushed from the dishes will be carried downwardly and broken up into particularly small particles that are then washed back on to the dishes. These small particles adhere to the cleaned items and often defy removal during subsequent rinsing steps in the operation of the machine.

An approach to correcting this problem has been to provide a means to remove food particles from the recirculating flow so that the washing liquid moving downwardly in the washing chamber carries food soil with it but the same washing liquid redistributed upwardly in the washing chamber is relatively free of these soil particles. To accomplish this a filtering medium in the form of a screen has been interposed in the path of the liquid recirculation whereby soil particles are prevented from further passage while washing liquid is free to move therethrough and be recirculated in the machine's washing chamber. The use of a filtering screen introduces its own problem; that of the need for cleaning the collected soil from the screen either between each use of the dishwasher or between wash and rinse steps of the operational cycle so that the screen does not become clogged and thereafter prevent passage of liquid therethrough.

One approach to the filter-cleaning problem has been to provide a removable filter that the machine operator can take out of the machine, rinse in the sink, and then reinstall in the machine for further use. Another and more popular approach has been the provision of a self-cleaning filter wherein the filter is flushed by a reversed flow or an automatic filter rinsing step provided in the operational cycle of the machine. A notable example of a dishwashing machine having a self-cleaning filtering arrangement is disclosed in U.S. Pat. No. 2,629,391 issued to F. S. Hummel on Feb. 24, 1953. Hummel teaches the provision of a filtering screen disposed over the sump in the bottom of a dishwashing machine's wash chamber. He also teaches the use of a specific liquid injection step to flush soil from the filter and also to wash collected soil from the sump and outwardly through a gravity drain line.

More recent examples of self-cleaning filter arrangements in dishwashers will be found in U.S. Pat. No. 3,090,391 issued to H. J. Kaldenberg et al. on May 21, 1963 and U.S. Pat. No. 3,575,185 issued to D. J. Barbulesco on Apr. 20, 1971. The Kaldenberg et al. and Barbulesco patents relate to dishwashing machines utilizing an annular sump arrangement provided circumjacent the axial flow pumping mechanism in a dishwasher and having an annular screen filter arrangement disposed in close proximity to the sump. Each of these patents teaches a different structure for a means for slinging liquid outwardly toward the annular filter whereby a backwash is accomplished to remove soil particles therefrom.

Commonly assigned U.S. Pat. No. 3,807,419, issued to the inventors hereof and dated Apr. 30, 1974, teaches the combination of a self-cleaning filter arrangement with a soil receptacle disposed at a position remote from the wash chamber's sump. Drainage means specifically provide for draining particles from the receptacle during the drain cycle. This type of filtering system is referred to as a "bypass" or "partial-flow" system since only a portion of the washing liquid is filtered at any given time. At present washing volumes and pump rates, the total volume of liquid is recirculated through the spraying system approximately 20 times per minute. Therefore, it is reasonable to conclude that all of the liquid eventually passes through the "bypass" filter. Of course, one of the primary advantages of this system, in addition to not requiring manual filter cleaning, is that the dishwasher will continue to operate even if the filter becomes completely clogged. The filter is cleaned or backflushed by the downwardly cascading washing liquid which impinges against the downstream-side of the filter screen. The soil-collecting receptacle is placed adjacent the back wall of the washing chamber and receives for the most part, recirculating liquid which falls downwardly along the back wall. Reliance on the downwardly cascading liquid along the back wall to supply liquid to the receptacle may not be entirely satisfactory for every dishwasher design or recirculation system.

SUMMARY OF THE INVENTION

It is therefore an object of this invention to provide supplemental liquid collecting means for supplying liquid to the soil-removal receptacle which would not normally fall or flow into the receptacle.

The present invention may be broadly summarized as relating to an automatic dishwashing machine of the type having a washing chamber and means therewith for providing washing liquid in the washing chamber and accumulating it at a relatively low level therein. The washing machine includes spray means for circulating the flow of washing liquid generally throughout the washing chamber, and a drainage sump is provided in the bottom wall of the chamber for supplying liquid to the spray means and for conducting soil-laden washing liquid or effluent out of the machine. A soil-collecting receptacle is provided in the wash chamber along the back wall thereof having an open portion disposed above the normal level of accumulated liquid in the chamber and in the path of a portion of the liquid recirculated within the chamber. Adjacent the soil-collecting receptacle is a fine-mesh screen filter disposed across the flow of liquid recirculation and adapted to pass liquid therethrough while blocking the passage of food soil particles. Two troughs are provided along the chambers side walls and disposed above the open portion of the soil-collecting receptacle. The troughs collect liquid falling downwardly along the side walls and carry the liquid to the receptacle for filtering. Means for draining the collected soil particles from the receptacle is also provided.

BRIEF DESCRIPTION OF THE DRAWINGS

FIG. 1 is a side elevational cut-away view of the bottom portion of a domestic dishwashing machine in accordance with the present invention.

FIG. 2 is a fragmentary sectional view taken along lines 2—2 of FIG. 1.

FIG. 3 is a fragmentary plan view taken along lines 3—3 of FIG. 1.

DETAILED DESCRIPTION OF THE PREFERRED EMBODIMENT

In FIG. 1 there is illustrated the lower portion of an automatic dishwashing machine 10 including a cabinet 11 defining therein a washing chamber 12. Access to the washing chamber 12 is obtained by opening a door 13 pivoted at its lower end and located on the front side of the cabinet 11. A dish rack 14 is shown supported for slidable movement within the washing chamber 12 so that it may be selectively slid outwardly through the cabinet's front access opening to facilitate loading and unloading of the items to be washed in the machine 10. The lower end of the washing chamber 12 is defined by a bottom wall or floor portion 15 that separates it from a lower motor-pump compartment 16. Housed within the compartment 16 is a motor-pump assembly 17 including an electric motor 18 that drives a pump means 19 for recirculating washing liquid to and from the washing chamber 12 and for draining washing liquid from the washing chamber 12 outwardly to the household sewage system. The operational cycle of such a machine generally includes a number of washing and rinsing steps and a final drying step. In a dishwasher machine, such as that shown in FIG. 1, heated water from the household supply line is directed into the washing chamber 12 by valve means actuated by a timer control (not shown). The water accumulates to a predetermined level on the floor portion 15 and then the timer control of the machine causes the electric motor 18 to be energized to drive the pump 19 in a recirculation operation. This method of fill is called the "static" method. A dynamic fill is also used whereby the motor is energized and the pump goes into the recirculation mode during the time controlled fill period. In the recirculation operation the accumulated washing liquid is drained out of the washing chamber 12 by means of a sump 20 emptying into a conduit 21 leading to the pump 19. The liquid is then forced upwardly by the pump 19 through a conduit 22 leading to a hollow horizontally elongated spray arm 25 located within the lower portion of the washing chamber 12.

Generally, clean water is introduced into the machine for each wash step and again for each rinse step, and detergent is added, by automatic means (not shown), for the wash step. The term "washing liquid" is therefore used herein in a generic sense to refer broadly to any form of cleansing liquid utilized for recirculation within the dishwashing machine. The washing liquid is distributed from the spray arm 25 by means of orifices 26 spaced therealong. The spray arm 25 is reactively driven by having at least one of the orifices disposed to discharge a jet stream in a direction such that the spray arm reacts to the force of the discharge and rotates in a horizontal plane. A thorough and generally uniform distribution of washing liquid in the washing chamber 12 is thereby obtained. Recirculation of the washing liquid from the washing chamber 12, through the pump 19 and, thence through the spray arm 25, is continued for a predetermined length of time after which the electrical circuit to a drain valve means (not shown) causes the valve means to automatically switch an outlet within the pump means 19 so that recirculation ceases and the pump 19 begins to discharge the washing liquid from the washing chamber 12 outwardly through a drain hose 27 leading ultimately to the household sewage system.

Commonly assigned co-pending patent application (9D-DW-10516) teaches a self-cleaning filter arrangement utilizing the spray arm 25 to clean the filter 32 (described below).

Shown in FIG. 1 and more specifically in FIG. 3, is a soil-removal means 82 in the form of a receptacle 30 having a trough 31 disposed in the path of recirculation of liquid within the washing chamber 12 and adapted to fill and overflow with the recirculated liquid caught therein. The soil-removal means further includes the filtering means 32 contiguous to the trough 31 and disposed in the path of the liquid flow whereby liquid from the receptacle passes through the screen while soil particles carried in the washing liquid are blocked from passage and therefore halt against the back or upstream side of the screen. As shown in FIG. 3, the trough 31 may be transversely elongated to extend across the substantially entire back wall 34 of chamber 12. In addition to the trough 31, the receptacle 30 further comprises a lower end portion in the form of a tubular box or hopper 35. The trough 31 has a configuration such that liquid and soil particles collected therein will flow centrally downwardly through an opening (not shown) into the hopper 35. A bottom **33*a* of the trough 31 is sloped centrally downwardly, and a back wall portion 33*b*, as shown in FIG. 1, is sloped inwardly whereby motion of the liquid collected in the trough will cause soil particles to flow toward the central bottom opening. The side of the trough 31 facing toward the wash chamber 12 has an erect wall portion 33*c* that extends upwardly to the lower edge of the filtering screen 32. It should be noted that wall 33*c* of trough 31 is at least partially above the normal level of washing liquid accumulated on the bottom 15 of chamber 12. The filtering screen 32 is disposed at approximately a 45° angle with reference to the back wall 34 of the wash chamber 12, and the upper long edge of the filtering screen 32 abuts against the forward edge of a horizontally disposed perforated cover plate 37. The cover plate 37 is disposed across the trough's opening and is provided with a uniform arrangement of apertures 38 equidistantly spaced thereacross, as shown in FIG. 3. Successive longitudinally oriented slots 39 are also provided in the cover plate 37. The cover plate 37 may be said to partially enclose a first open top means 88 of receptacle 30 serving to collect recirculating liquid falling therein. Cover plate 37 also forms a second open top means 89 of receptacle 30 wherein the filter 32** is secured as described above.

For more detailed illustration and description of the soil-removing means 82 reference may be made to the above-mentioned commonly-assigned U.S. Pat. No. 3,807,419, and specifically FIGS. 2–4 thereof.

Referring to FIGS. 1 and 2, and more specifically to FIG. 2, the supplemental liquid collecting and conduit means 70 is shown. The conduit means 70 is shown as it would appear on the left side of chamber 12 looking front to back. It includes an open trough 71 having a vertical mounting section **71*a* for attachment to the interior of wall 11 of chamber 12, a bottom 71*b* extending inwardly and horizontally from wall 11 and a vertical side wall 71*c* sloped slightly inwardly as it rises from the bottom 71*b*. The trough 71 is attached to wall 11 by any suitable means such as welding, or may be formed as part of the side wall where the chamber 12** is formed from a polypropylene resin (as is presently known to those skilled in the art). Referring to FIG. 1, the trough is mounted above the soil-removal means 82 and is sloped downwardly toward the soil-removal means. The elongated trough 71 extends along substantially the entire width of the side wall 11 with its rearward terminal end 71*d* located over the open top section 88 of trough 31. During the recirculation of washing liquid within chamber 12, the liquid splashing against the side walls of the chamber cascades downwardly falling into the trough 71 wherein it flows down the trough 71 and on to the cover plate 37 of trough 31. Thus, liquid which would normally fall directly onto the bottom 15 of chamber 12 is collected and distributed to the soil-removal means 82 for filtering. This in turn causes the total volume of liquid used in any one cycle to be filtered a greater number of times per cycle resulting in cleaner recirculated washing liquid and more effective cleaning performance.

In the operation of the dishwasher 10 shown in FIG. 1, the washing step of the operational cycle commences with the introduction of water to the washing chamber 12 whereby water accumulates on the floor portion 15 to a maximum level below the under surface of the spray arm 25 and below the bottom-most portion of screen 32. Detergent is automatically added to the water and the resultant washing liquid is caused to follow a circular path down the sump 20 and through the conduit 21 to the pump 19. As heretofore described, motor 18 causes the pump 19 to force the washing liquid upwardly and outwardly through the hollow spray arm 25. The spray arm 25 rotates in response to a jet stream discharged from at least one end thereof and the orifices 26 discharge streams of washing liquid upwardly over items stored in the rack 14 and generally over additional items in one or more other vertically spaced racks (not shown). The cascade of washing liquid distributed through the washing chamber 12 tends to progress downwardly over the items in the rack but primarily down along the inside surface of the door 13, the side walls of the wash chamber 12 and the back wall 34. Therefore, the back wall 34 and the troughs 71 serve to direct recirculated washing liquid downwardly against the cover plate 37.

As the washing step (or rinsing step) progresses for its predetermined time, the soil-laden washing liquid flows downwardly repeatedly along the washing chamber back wall 34 and the troughs 71 toward the cover plate 37. The washing liquid moves through the slots 39 and the perforations 38 of the cover plate 37 and into the trough 31. Obviously, once the trough 31 is initially filled, it flows over its forward wall 33*c* and outwardly through the filtering screen 32. The filtering screen 32 is preferably of a fine mesh whereby even very small food soil particles will be blocked from passage therethrough and retained by the back side of the filtering screen 32. The filtering screen 32 is disposed whereby washing liquid moving down behind the rack 14 and forward of the back wall 34 will strike against the outside surface of the screen. The force of the downwardly cascading washing liquid impinges against the outside surface of the screen 32 serving to jar soil loose from the back side of the screen 32 whereby it will continuously move away from the screen as it collects thereagainst to keep the screen open for passage of washing liquid therethrough. As quantities of soil particles retained in the trough 31 by the screen 32 increase and agglomerate, they tend to precipitate and settle downwardly into the tubular hopper 35 so that by the end of the wash step of the machine's operational cycle a high percentage of suspended soil particles have thus been removed from the recirculated washing liquid in the wash chamber 12 and collected in the hopper 35. At the end of the washing step, the timer-control means (not shown) energizes the drain valve means for a period to permit final drainage of liquid from the cleaned items in the chamber 12. After the drain valve is automatically moved from the first to the second position the pump 19 continues to receive the washing liquid from the chamber 12 through the sump 20 and the conduit 21 and will pump it outwardly through the drain line 27 to the lower end of the hopper 35. The drainage flow or effluent is pumped through the hopper and outwardly through a final discharge line 44 draining outwardly from the dishwasher 10. The final discharge line 44 on a permanently installed dishwasher would lead directly to the household sewage system. On a portable type of dishwashing machine the final discharge line 44 would be provided with an outer end disposed to dispense the effluent liquid into the kitchen sink.

In order to accomplish effective drainage of hopper 35 various mechanisms may be employed. Two such devices are shown and described in the above-mentioned commonly-assigned U.S. Pat. No. 3,807,419, and specifically FIGS. 4 and 5 thereof.

It should be apparent to those skilled in the art that the embodiments described heretofore are considered to be the presently preferred forms of this invention. In accordance with the Patent Statutes, changes may be made in the disclosed mechanism in the manner in which it is used without actually departing from the true spirit and scope of this invention. For example, the disclosed supplemental collecting troughs could be formed as an extension or part of one of the dish racks, either at the sides of the rack or along the area therebetween. Such "rack troughs" would then collect recirculating liquid falling along the chamber side walls or that which falls or cascades downwardly without contacting the walls of the washing chamber. Many dish racks are suspended from inwardly projecting tracks formed or attached to the interior side walls; the troughs disclosed herein could also be formed as part of these tracks.

It should also be understood that this invention could be applied with equal success in a dishwasher having a spray system different from or in addition to the horizontally rotating spray arm 25; for example, dishwashers which utilize supplemental vertical spray towers or horizontally mounted spray tubes which are known in the art.

What is claimed is:

1. In an automatic dishwashing machine having a wash chamber, means for accumulating washing liquid in the lower portion of the chamber and circulating a flow of washing liquid throughout the chamber, soil-removal means independent of the accumulating means and disposed adjacent an inner chamber side in the path of a portion of the recirculating liquid for filtering and collecting soil particles, the soil-removal means including means for effecting drainage thereof at a predetermined time during operation of the machine, the improvement comprising: conduit means independent of said accumulating means and said soil-removing means and disposed in flow path generally upstream of said soil-removal means, said conduit means operative to collect recirculated liquid for distribution to said soil-removing means, whereby liquid which would not normally flow into said soil-removal means is filtered thereby.

2. The combination of claim 1 wherein said soil-removing means is generally disposed above the normal level of accumulated liquid in the lower portion of said chamber.

3. The combination of claim 1 wherein said conduit means comprises an elongated trough having a bottom and an upwardly extending wall portion, said bottom disposed along a plane generally horizontal to said lower portion of said chamber and said wall spaced from and sloped away from at least one of the vertical walls of said chamber as it rises vertically from said bottom.

4. The combination of claim 3 wherein said trough is fastened to at least one of said chamber walls and is downwardly sloped in the direction of said soil-removal means.

5. The combination of claim 1 wherein said conduit means is formed along at least one of the internal side walls of said chamber and said soil-removal means is adjacent the back wall of said chamber.

6. The combination of claim 1 wherein said conduit means is positioned to collect recirculated liquid which splashes against and cascades downwardly from the internal side walls of said chamber.

* * * * *